US005382307A

United States Patent [19]

Kageyama et al.

[11] Patent Number: 5,382,307

[45] Date of Patent: Jan. 17, 1995

[54] PROCESS FOR MANUFACTURING HIGH-STRENGTH BAINITIC STEEL RAILS WITH EXCELLENT ROLLING-CONTACT FATIGUE RESISTANCE

[75] Inventors: Hideaki Kageyama; Masaharu Ueda; Kazuo Sugino, all of Kitakyushu, Japan

[73] Assignee: Nippon Steel Corporation, Tokyo, Japan

[21] Appl. No.: 201,924

[22] Filed: Feb. 24, 1994

[30] Foreign Application Priority Data

| | | | |
|---|---|---|---|
| Feb. 26, 1993 | [JP] | Japan | 5-037959 |
| May 21, 1993 | [JP] | Japan | 5-120265 |
| May 31, 1993 | [JP] | Japan | 5-129729 |
| May 31, 1993 | [JP] | Japan | 5-129730 |
| Jul. 22, 1993 | [JP] | Japan | 5-181663 |
| Jul. 22, 1993 | [JP] | Japan | 5-181664 |

[51] Int. Cl.[6] ..... C21D 9/04; C22C 38/18

[52] U.S. Cl. ..... 148/584; 148/320

[58] Field of Search ..... 148/584, 320

[56] References Cited

U.S. PATENT DOCUMENTS

| | | | |
|---|---|---|---|
| 1,896,572 | 2/1933 | Brunner | 148/584 |
| 4,008,078 | 2/1977 | Flugge et al. | 75/124 |
| 4,933,024 | 6/1990 | Fukuda et al. | 148/584 |
| 5,004,510 | 4/1991 | Yu et al. | 148/146 |
| 5,328,531 | 7/1994 | Gautier | 148/584 |

FOREIGN PATENT DOCUMENTS

| | | |
|---|---|---|
| 0469560 | 2/1992 | European Pat. Off. . |
| 2543750 | 4/1976 | Germany . |
| 2501175 | 7/1976 | Germany . |
| 2940826 | 4/1981 | Germany . |
| 50-140316 | 11/1975 | Japan . |
| 55-23885 | 6/1980 | Japan . |
| 59-19175 | 5/1984 | Japan . |
| 1450355 | 9/1976 | United Kingdom . |

OTHER PUBLICATIONS

Data base WPI, Section Ch, Week 8029, Class M24–D03, AN 80–51085C, Derwent Publications, Ltd., corresponding to JP55–023885.

Data base WPI, Section Ch, Week 8421, Class M24–D03, AN 80–81348C, Derwent Publications Ltd., corresponding to JP59–019173.

Patent Abstracts of Japan, vol. 2, No. 35, (E–020), Mar. 9, 1978, corresponding to JP53–001074.

European Search Report EP 94 10 2721.

*Primary Examiner*—Deborah Yee

*Attorney, Agent, or Firm*—Kenyon & Kenyon

[57] ABSTRACT

A process for manufacturing high-strength bainitic steel rails with an excellent rolling-contact fatigue resistance comprising the steps of hot rolling steel containing 0.15% to 0.45% carbon, 0.15% to 2.00% silicon, 0.30% to 2.00% manganese, 0.50% to 3.00% chromium, and at least one element selected from a group of molybdenum, nickel, copper, niobium, vanadium, titanium and boron, subjecting the hot-rolled rail to an accelerated cooling from the austenite region to a temperature between 500° to 300° C., at which the accelerated cooling is stopped, at a rate of 1° to 10° C. per second, and then further cooling the rail to a lower temperature by natural or controlled cooling. The obtained rail exhibits a hardness of Hv 300 to 400 in the center of the rail head surface of the head and not lower than Hv 350 in the gage corner, and the hardness of the gage corner is higher than that of the center of the rail head surface by Hv 30 or more.

10 Claims, 2 Drawing Sheets

PROCESS FOR MANUFACTURING HIGH-STRENGTH BAINITIC STEEL RAILS WITH EXCELLENT ROLLING-CONTACT FATIGUE RESISTANCE

BACKGROUND

This invention relates to processes for manufacturing high-strength bainitic steel rails having a head surface with excellent rolling-contact fatigue resistance required of the rails used in high-speed railroads, and more particularly to high-strength rails having a bainitic structure resistant to fatigue cracks that could occur in the gage corner between the head and the sides of rails and the squat or dark spot appearing at the top plane of the rail head surface and processes for manufacturing such rails.

Recently the weight of loads carried and speed of travel have been improve to increase the efficiency of railroad transportation. Thus, railroad rails are now subjected to more severe service conditions and, therefore, required to have higher quality.

Concrete problems include a sharp increase in the wear of rails installed in curves and the incidence of fatigue crack developing from the interior of the gage corner which is the principal contact point of rails with the wheels of trains running thereover.

The following solutions have been employed for the problems just described:

(1) As rolled rails of alloyed steels prepared by adding large quantities of copper, molybdenum and other alloying elements. (Refer to Japanese Provisional Patent Publication No. 140316 of 1975.)

(2) Heat-treated rails of non-alloyed steels manufactured by applying accelerated cooling (by air-mist cooling) to the head or entirety of the rail between 700° and 550° C. (Refer to Japanese Patent Publication No. 23885 of 1980.)

(3) Heat-treated rails of low-alloy steels having improved wear and fatigue crack resistance and capability to form harder welds prepared by the addition of lower percentage of alloying elements. (Refer to Japanese Patent Publication No. 19173 of 1984.)

These high-strength rails are made of steels having bainitic, ferritic and fine-pearlitic structures to improve their resistance to wear and resistant inner fatigue defects.

In tandent and gently curved tracks of railroads where not much resistance to wear and inner fatigue defects is required, repeated contacts between wheels and rails cause rolling-contact fatigue failures on the rail head surface. This results rolling contact fatigue or transverse defects resulting from the propagation of fatigue cracks started at the top plane of the rail head surface into the interior thereof. The failures called "squat" or "dark spot" that appears mainly in the tangent tracks of high-speed railroads is a typical example. Although the occurrence of such failures has been known, conventional as-rolled rails with pearlitic structures are used in the tangent and gently curved tracks.

After a certain period of time (or after a certain tonnage of loads has been carried thereover), failures due to rolling-contact fatigue starts from the center of the rail head surface used in the tangent or gently curved tracks of railroads serving mainly for transporting passengers. Investigation by the inventors has revealed that the failures just described are due to the pile-up of damage on the center of the rail head surface that results from the repeated contacts between wheels and rails.

This failures can be eliminated by grinding the rail head surface at given intervals. However, the costs of the grinding car and operation are high and the time for grinding is limited by the running schedule of trains.

Another solution increases the wear rate of the rail head surface so that the accumulated fatigue damage were away before the defects occure. The wear rate of rails can be increased by decreasing their hardness as their wear resistance depends on steel hardness. However, simple reduction of steel hardness causes plastic deformation on the surface of the rail head which, in turn, causes head checks and other damages called flaking. Therefore, it has been difficult to effectively prevent the occurrence of the failure described above in the conventional rails of steels with pearlitic structures.

SUMMARY

Conventional rails have been primarily made of steels with pearlitic structures. The pearlitic structure is a combination of soft ferrite and lamellae of hard cementite. On the rail head surface that comes in contact with wheels, soft ferrite is squeezed out to leave only the lamellae of hard cementite. This cementite and the effect of work hardening provides the wear resistance required of rails. At the same time, however, layered flow of structure (metal flow) occurs from the top end surface of the rail to its interior and cracks develop therealong.

The bainitic structure, which wears away more than the pearlitic structure, consists of particles of carbide finely dispersed through the matrix of a soft ferritic structure. Wheels running over the rails of bainitic structures, therefore, cause the carbide to readily wear away with the ferritic matrix. The wear thus accelerated removes the fatigue-damaged layer from the rail head surface of the rail head. The as-rolled rail of low-alloy steel with a bainitic structure disclosed in Japanese Provisional Patent Publication No. 14316 of 1975 suffers a reduction in strength because of the massive ferritic matrix and coarsely dispersed particles of carbide. This reduction in strength causes a continuous flow of structure (metal flow) in a direction opposite to the direction in which the train runs on the running surface directly under the wheels thereof, with cracks occurring along the metal flow.

This problem can be solved by making rails of steels with bainitic structures prepared by adding higher percentages of chromium or other alloying elements to provide the required high strength as rolled. However, increased alloy additions are not only costly but also form a hard and brittle martensitic structure in the welded joints between rails.

An object of this invention is, therefore, to provide high-strength rails of low-alloy steels with strong bainitic structures having excellent rolling-contact fatigue resistance. This object is achieved by cooling the rail head hot rolled or reheated to a high temperature from the austenite region under properly controlled conditions.

Another object of this invention is to provide high-strength rails with excellent rolling-contact fatigue resistance freed from fatigue failures on the gage corner between the head and sides of rails and the failure called squat or dark spot.

Still another object of this invention is to provide high-strength rails of steels with bainitic structures with excellent rolling-contact fatigue resistance which have a hardness of Hv 300 to 400 in the center of the rail head surface and a minimum of Hv 350 in the gage corner, with the hardness of the gage corner being greater than that of the center of the rail head surface by a minimum of Hv 30.

The above and further objects and features of this invention will be made explicit in the following detailed description which is to be read by reference to the accompanying drawings.

DRAWINGS

DESCRIPTION

Figure 1:
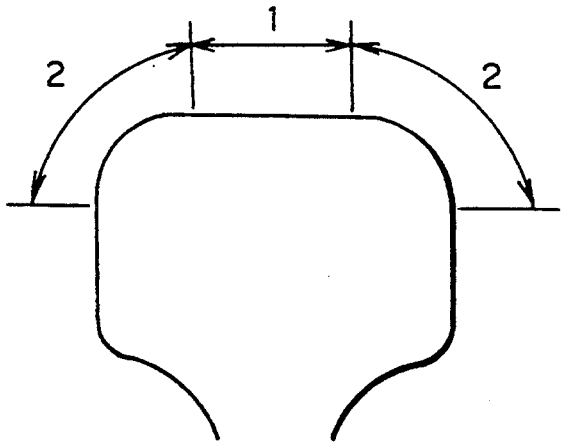
FIG. 1 shows a cross-section of a rail head with nomenclature.

The above objects of this invention are achieved by the following:

(1) A process for manufacturing high-strength bainitic steel rails with excellent rolling-contact fatigue resistance comprising the steps of hot-rolling steels of the following compositions into rails, subjecting the head of the hot-rolled rails retaining or heated to a high temperature to accelerated cooling from the austenite region to a cooling stop temperature of 500° to 300° C. at a rate of 1° to 10° C. per second, and then to natural cooling to a lower temperature zone, the steels containing, by weight, 0.15% to 0.45% carbon, 0.15% to 2.00% silicon, 0.30% to 2.00% manganese, 0.50% to 3.00% chromium, plus, as required, at least one element selected from a first group consisting of 0.10% to 0.60% molybdenum, 0.05% to 0.50% copper, and 0.05% to 4.00% nickel, a second group consisting of 0.01% to 0.05% titanium, 0.03% to 0.30% vanadium, and 0.01% to 0.05% niobium, and a third group consisting of 0.0005% to 0.0050% boron, with the remainder consisting of iron and unavoidable impurities.

(2) A process for manufacturing high-strength bainitic steel rails with excellent rolling-contact fatigue resistance similar to the one described in (1) above, except in that following the completion of the accelerated cooling the rail head surface is heated to a temperature higher than the temperature attained on completion of the accelerated cooling by a maximum of 150° C. using the heat recuperated from the interior of the rails and then naturally cooled down to a lower temperature zone.

(3) A process for manufacturing high-strength bainitic steel rails with excellent rolling-contact fatigue resistance similar to the one described in (2) above, except in that the heating with the heat recuperated from the interior of the rails is limited to a maximum of 50° C. above the temperature attained on completion of the accelerated cooling.

(4) A process for manufacturing high-strength bainitic steel rails with excellent rolling-contact fatigue resistance similar to the one described in (1), except in that the rail head subjected to the accelerated cooling is cooled down to the vicinity of room temperatures at a rate of 1° to 40° C. per minute.

High-strength bainitic steel rails with excellent rolling-contact fatigue resistance manufactured from the steels of the compositions described above that have a bainitic structure obtained by applying accelerated cooling from the austenite region to a cooling stop temperature of 500° to 300° C. at a rate of 1° to 10° C. per second and then further cooling down to the vicinity of room temperatures, with the hardness of the center of the rail head surface ranging from Hv 300 to Hv 400, that of the gage corner being not lower than Hv 350, and the hardness of the center of the rail head surface being higher than that of the gage corner by a minimum of Hv 30 are also within the scope of this invention. Hv as used in this specification denotes Vickers hardness.

A detailed description of this invention is given below.

The reason for limiting the chemical composition of the rails according to this invention is as follows:

Carbon is essential for obtaining a given hardness. While carbon content under 0.15% is insufficient for attaining the wear resistance required of rails, that in excess of 0.45% forms larger amounts of pearlitic structures detrimental to the surface quality of rails, greatly reduces the rate of bainite transformation to such an extent as to inhibit the accomplishment of complete bainite transformation in the heat recuperation process after accelerated cooling and cause the formation of martensitic structures detrimental to the toughness of rails. This is why the carbon content is limited between 0.15% and 0.45%.

Silicon increases the strength of steels by forming solid solutions in the ferritic matrix of bainitic structures. While no such strength increase is possible with silicon contents not higher than 0.15%, the incidence of surface defects during rolling increases, martensite are formed in bainitic structures, and the toughness of rails deteriorates when silicon content exceeds 2.00%. Hence, the silicon content is between 0.15% and 2.00%.

Like carbon, manganese increases the hardenability of steels, makes finer bainitic structure, and enhance both strength and toughness at the same time. While little improving effect is obtainable below 0.30%, the incidence of the formation of pearlitic structures that promote the occurrence of surface failure increases in excess of 2.00%. Therefore, the manganese content is limited between 0.30% and 2.00%.

Chromium is an important element that provides a given strength by finely dispersing the carbide in bainitic structures. Chromium contents under 0.50% coarsen the dispersion pattern of carbide in bainitic structures, thereby causing plastic deformation of metal and accompanying surface defects. Chromium contents not lower than 3.00% cause the coarsening of carbides, greatly decrease the speed of bainite transformation to such an extent as to inhibit the accomplishment of bainite transformation in the heat recuperation process after accelerated cooling and cause the formation of martensitic structures detrimental to the toughness of rails. This is why the chromium content is limited between 0.50% and 3.00%.

Furthermore, one, two or more of the elements described below may be added as required to the steels of the compositions described above. A first group consisting of 0.10% to 0.60% molybdenum, 0.05% to 0.50% copper and 0.05% to 4.00% nickel is added principally for strengthening the bainitic structures in steels. A second group consisting of 0.01% to 0.05% titanium, 0.03% to 0.30% vanadium and 0.01% to 0.05% niobium is added mainly for enhancing the toughness of steels. Addition of 0.0005% to 0.0050% boron permits more stable formation of bainitic structures. The reasons why the addition of the elements listed above is limited are given below.

Like chromium, molybdenum is indispensable for the strengthening and stabilization of bainitic structures as well as for preventing the temper brittleness induced by welding. While no sufficient effect is obtainable under 0.10%, molybdenum contents in excess of 0.60% greatly decrease the speed of bainite transformation to such an extent as to inhibit the accomplishment of complete bainite transformation in the heat recuperation process after accelerated cooling and cause the formation of martensitic structures detrimental to the toughness of rails. This is why the molybdenum content is limited between 0.10% and 0.60%.

Copper increases the strength of steels without impairing their toughness. While maximum effect is obtainable between 0.05% and 0.50%, copper in excess of 0.50% causes hot shortness. Hence, copper content is 0.05% to 0.50%.

Nickel stabilizes austenite grains, lowers the bainite transformation temperature, refines bainitic structures, and increases both strength and toughness of steels. While these effects are limited under 0.05%, addition in excess of 4.00% produces no further increase in the improving effect. Therefore, the nickel content is limited between 0.05% and 4.00%. Addition of titanium is conducive to the formation of fine austenite grains during the rolling and heating processes of rails because the precipitated titanium carbonitrides do not dissolve even at high temperatures. However, this effect is limited under 0.01%, whereas titanium addition over 0.05% is detrimental because of the coarsening of titanium nitride that serves as the original for fatigue cracks in the rails. Hence, the titanium content is limited between 0.01% and 0.05%.

Although vanadium strengthens bainitic structures through the precipitation of vanadium carbonitrides, the strengthening effect is insufficient when its addition is not more than 0.03%. On the other hand, vanadium addition over 0.30% causes brittleness as a result of the coarsening of vanadium carbonitrides. Therefore, the vanadium content is 0.03% to 0.30%.

Niobium refines austenite grains and enhances the toughness and ductility of steels for rails. Because sufficient enhancing effect is unobtainable under 0.01% and addition in excess of 0.05% causes embrittlement by forming intermetallic compounds, the niobium content is limited between 0.01% and 0.05%.

Boron has the effect of suppressing the production of ferrite at the grain boundaries, thereby permitting the stable production of bainitic structures. However, sufficient effect is unobtainable below 0.0005%, whereas addition in excess of 0.0050% deteriorates the quality of rails as a result of the formation of coarse-grained compounds of boron. Hence, the boron content is limited between 0.0005% and 0.0050%.

Steels of the compositions described above are melted in basic oxygen, electric or other commonly used melting furnaces. The obtained steels are then made into bloom through a combination of ingot casting and primary rolling processes or by continuous casting. The bloom are then hot-rolled into rails of the desired shapes.

The head of the rails thus produced is subjected to accelerated cooling from the austenite region to a cooling stop temperature of 500° to 300° C. at a rate of 1° to 10° C. per second. This accelerated cooling is applied to freshly rolled rails that still retain as much heat as to remain in the austenite region or those that have been reheated up to the austenite region.

Following the accelerated cooling, the rail head is further cooled down to the vicinity of room temperatures. Either natural cooling accompanying heat recuperation or forced cooling at a rate of 1° to 40° C. per minute may be applied depending on the object. In the former case, the temperature increase resulting from the heat recuperation up to 150° C. occurring in the interior of rails is used. Such rails are first subjected to accelerated cooling to start bainite transformation in a lower temperature region. Then, stable growth of fine bainitic structures is made possible by utilizing a temperature increase induced by the heat recuperation. In the latter case, bainite transformation is caused to take place in a lower temperature region, and the subsequent cooling causes the stable formation of fine and strong bainitic structures.

The reasons for specifying the rate of accelerated cooling and the range of the cooling stop temperature as stated above will be described below.

First, the reason for limiting the accelerated cooling rate down to the cooling stop temperature between 1° and 10° C. per second is as follows: If steels of the above compositions are cooled at a slower rate than 1° C. per second, bainite transformation begins in a higher-temperature zone midway in the cooling process, entailing the formation of coarse-grained bainitic structures that reduce the strength of rails and induce surface defects. This is the reason why the lower limit is set at 1° C. per second. If cooling is effected at a rate faster than 10° C. per second, large amounts of heat is generated in the interior of rails in the subsequent heat recuperation process, followed by the formation of coarse-grained bainitic structures that reduce the strength of rails and induce surface damages as mentioned above. Hence, the upper limit is set at 10° C. per second.

The reason for limiting the range of the cooling stop temperature between the austenite region to between 500° and 300° C. is as follows: If cooling is stopped at a temperature above 500° C., coarse-grained bainitic structures, which decrease the strength of rails and induce surface defects, tend to form in the heat recuperation region, depending on the conditions of subsequent cooling. This the reason why the upper limit is set at 500° C. To obtain a finer bainitic structure, the upper limit should preferably be not higher than 450° C. If cooled down to lower temperatures than 300° C., on the other hand, martensitic structures are formed in bainitic structures. Depending on the conditions of subsequent cooling, sufficient heat recuperation does not take place in the interior of rails, thereby leaving large amounts of hard martensitic structures unremoved. To avoid the undesirable marked reduction in rail toughness, the lower limit is set at not lower than 300° C. To obtain a stable bainitic structure, the accelerated cooling stop temperature should preferably be not lower than 350° C. because the Ms temperature of the steels of the compositions according to this invention is not higher than approximately 350° C.

One of the cooling methods employed after stopping the accelerated cooling is natural (or spontaneous) cooling accompanying heat recuperation.

The heat recuperation used in this invention is limited to the natural recuperation from the interior of the rail. No forced heating or cooling from outside is applied. An experiment was conducted to subject the head of rails of the compositions according to this invention to accelerated cooling from the austenite region at a rate of 1° to 10° C. per second that was stopped at temperatures between 400° and 300° C. Temperature increase due to natural heat recuperation of 50° to 100° C. on the average (some specimens exhibiting as high a temperature increase as nearly 150° C.) was confirmed to occur in the rail head. In the steels of the compositions stated before, fine-grained bainitic structures transform in the temperature range of 500° to 300° C. (preferably not lower than 350° C.). When the above accelerated cooling rate and stop temperature are selected, the temperature after heat recuperation falls in the range of 500° to 350° C. that coincides with the temperature range in which high-strength bainitic structures transform.

A temperature increase (heat recuperation) of approximately 100° C. in the temperature range in which accelerated cooling is stopped secures the desired strength of bainitic steels. However, the same heat recuperation could coarsen part of the structure, with a resulting impairment of toughness. In another experiment, therefore, the head of rails of the compositions according to this invention was subjected to accelerated cooling from the austenite region at a rate of 1° to 10° C. After stopping the accelerated cooling between 400° and 300° C., the heat recuperation from the interior of the rails was suppressed. Then, it was found that the coarsening of bainitic structures could be prevented by keeping the temperature increase in the rail head due to heat recuperation below 50° C. Then, bainitic structures having high strength and toughness was obtainable.

Based on the results of these experiments, the processes according to this invention permit stable growth of fine-grained bainitic structures by starting bainite transformation in a lower temperature zone by subjecting steels to accelerated cooling from the austenite region at a rate of 1° to 10° C. and stopping the accelerated cooling at temperatures between 500° and 300° C., and utilizing a temperature increase to a maximum of 150° C. caused by natural cooling including heat recuperation or suppressing such heat recuperation within certain limits.

The objects of this invention can also be achieved by applying controlled cooling between 1° and 40° C. after stopping the accelerated cooling. To impart the desired strength, it is preferable to control the cooling after the accelerated cooling by, for example, speeding it up in the case of rails of larger cross sections and slowing it down in the case of rails of smaller cross sections. Such controlled cooling assures the attainment of strong fine-grained bainitic structures. The reason why the cooling rate is limited as stated above is as follows: Cooling at slower rates than 1° C. per minute results in the precipitation of coarse carbides in bainitic structures which greatly reduces the strength and toughness of the rail head. Cooling at faster rates than 40° C. per minutes, on the other hand, inhibits the accomplishment of complete bainite transformation depending on the cooling stop temperature. The martensite transformation that could occur during this cooling may form hard martensite detrimental to the toughness of rails in bainitic structures.

Depending on the selected steel composition and accelerated cooling rate, bainite transformation may begin in the course of accelerated cooling in the temperature range of 500° to 300° C. where the accelerated cooling is stopped and end in the subsequent heat recuperation process, or it may begin and end in the heat recuperation process immediately after the accelerated cooling. Both bainitic structures formed in the cooling stop temperature range are fine-grained and have little adverse effects on the strength, toughness and surface defects resistance of rails. Therefore, the bainitic structures in the steels for rails according to this invention may be formed both in the course of accelerated cooling in the temperature range of 500° to 300° C. where the accelerated cooling is stopped and in the heat recuperation process following the accelerated cooling.

The metal structure obtained after cooling should preferably be bainitic. Depending on the selected accelerated cooling rate and cooling stop temperature, however, extremely-fine-grained martensitic structures might be mixed in bainitic structures, which could eventually remain as martensite tempered by the heat recuperated from the interior of the rail. As the presence of fine-grained tempered martensite in bainitic structures has little adverse effects on the strength, toughness and surface defects resistance of rails, the bainitic steels for rails according to this invention can contain small amounts of tempered martensitic structures.

Accelerated cooling is performed by air, mist or other air-atomized liquids from nozzles disposed on both sides of the rail head. The rail heads subjected to the accelerated and subsequent cooling described above should preferably have a hardness of Hv 300 to 400 at the center of the rail head surface and not lower than Hv 350 in the corner, with a strength of not less than 1000 Mpa. The rail heads having as much hardness and strength as stated above are sufficiently resistant to the running surface defects that could occur in the tangent tracks of railroads and the corner surface damages occurring in the gently curved sections or resulting from the meandering of high-speed trains.

The bainitic steel rails manufactured by the processes of this invention described above have the surface defects resistance required of high-strength rails for high-speed railroads.

Next, some examples of this invention will be given. FIG. 1 shows a cross section of the head of the JIS 60 kg/m class rails with nomenclature. Reference numerals 1 and 2 respectively designate the center of the rail head surface and corner that make up a portion called the rail head.

EXAMPLE 1

Figure 2:
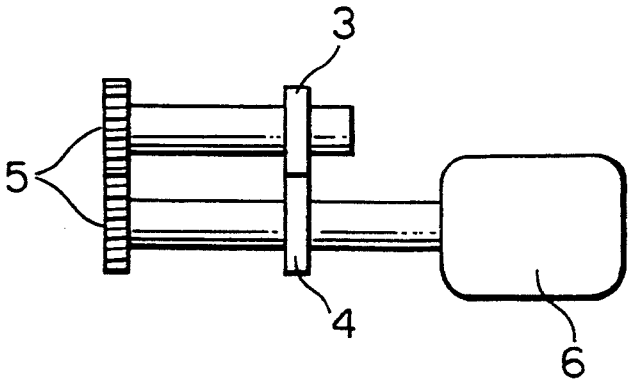
FIG. 2 is a schematic diagram of Nishihara's wear tester.
Figure 3:
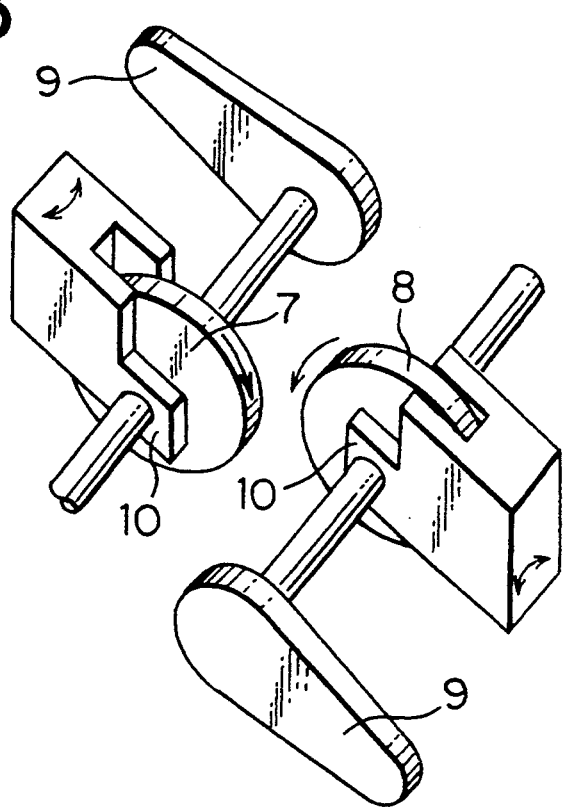
FIG. 3 is a schematic diagram of a rolling-contact fatigue tester.

Table 1 shows the chemical compositions and cooling conditions of rails according to this invention and rails tested for comparison. Table 2 shows their hardness, amounts of wear determined after applying loads 500,000 times under dry conditions using Nishihara's wear tester, and the number of loadings applied before surface defects appeared in the water-lubricated rolling-contact fatigue test on rails and disk-shaped specimens prepared by reducing the configuration of wheels to a scale of $\frac{1}{4}$. FIG. 2 is a schematic diagram of Nishihara's wear tester, in which reference numeral 3 designates a rail specimen, 4 a wheel specimen, 5 a pair of gears, and 6 a motor. FIG. 3 is a schematic diagram of a rolling-contact fatigue tester, in which reference numeral 7 designates a rail specimen, 8 a wheel specimen, 9 a motor, and 10 a bearing box.

Details of the rails tested and testing procedures are given below.

Rails of This Invention (10 Pieces)

A to J: Rails with bainitic structures prepared by naturally cooling the rail head after accelerated cooling.

TABLE 1

| Rail | Simbol | Chemical Composition (wt %) C | Si | Mn | P | S | Cr | Other Element Added | Cooling Conditions: Cooling Start Temperature (°C.) | Cooling Accelerating Rate (°C./sec) | Cooling Stop Temperature (°C.) | Temperature Increase by Heat Recuperation (°C.) | Structure |
|---|---|---|---|---|---|---|---|---|---|---|---|---|---|
| This Invention | A | 0.28 | 0.30 | 1.21 | 0.013 | 0.009 | 1.65 | V: 0.08 | 850 | 3 | 300 | 51 | Bainite |
| | B | 0.31 | 0.31 | 1.32 | 0.013 | 0.008 | 1.32 | Mo: 0.26 | 800 | 4 | 370 | 86 | Bainite |
| | C | 0.29 | 0.55 | 1.10 | 0.010 | 0.006 | 2.21 | Nb: 0.04 | 700 | 5 | 360 | 81 | Bainite |
| | D | 0.34 | 0.32 | 0.70 | 0.011 | 0.007 | 2.51 | B: 0.0015 | 800 | 8 | 340 | 94 | Bainite |
| | E | 0.32 | 0.29 | 0.41 | 0.012 | 0.007 | 2.81 | Mo: 0.59 | 850 | 1 | 400 | 54 | Bainite |
| | F | 0.25 | 0.15 | 0.31 | 0.011 | 0.009 | 2.98 | Ni: 2.41 | 800 | 10 | 400 | 100 | Bainite |
| | G | 0.45 | 0.31 | 0.64 | 0.011 | 0.007 | 2.21 | — | 750 | 5 | 320 | 62 | Bainite |
| | H | 0.35 | 1.98 | 0.74 | 0.012 | 0.007 | 2.41 | Ti: 0.032 | 800 | 5 | 360 | 82 | Bainite |
| | I | 0.38 | 0.51 | 1.99 | 0.014 | 0.009 | 0.51 | Cu: 0.11 | 800 | 4 | 330 | 62 | Bainite |
| | J | 0.15 | 0.51 | 1.41 | 0.012 | 0.007 | 0.95 | Mo: 0.41, Ni: 3.89 | 800 | 8 | 380 | 95 | Bainite |
| For Comparison | K | 0.30 | 0.29 | 1.21 | 0.016 | 0.008 | 1.21 | — | 850 | 15 | 420 | 135 | Bainite |
| | L | 0.30 | 0.29 | 1.22 | 0.015 | 0.008 | 1.19 | — | | Natural cooling after rolling | | | Bainite |
| | M | 0.69 | 0.25 | 0.89 | 0.013 | 0.007 | — | — | | Natural cooling after rolling | | | Pearlite |

Note: The remainder of both surface-damage- and wear-resistant steels is iron.

Rails Tested for Comparison (3 Pieces)

K: Rail with bainitic structure prepared by naturally cooling the rail head after accelerated cooling.

L: Rail with bainitic structure prepared by allowing to cool naturally after rolling.

M: Rail with pearlitic structure prepared by allowing to cool naturally after rolling.

The test conditions were as follows:

Wear Test (Common to All Tested Rails)

Testing machine: Nishihara's wear tester

Specimen configuration: Disk-shaped (outside diameter=30 mm, inside diameter=16 mm, thickness=8 mm)

Test load: 490N

Slip ratio: 9%

Rubbed against: Tempered martensitic steel (Hv 350)

Atmosphere: In the atmosphere

Frequency of loading: 500,000 revolutions

Rolling-Contact Fatigue Test

Testing machine: Rolling-contact fatigue tester

Specimen configuration: Disk-shaped (outside diameter=200 mm, cross-section of rail specimen=$\frac{1}{4}$ of 60 kg/m class rail)

Test load: 1.5 tons (radial load)

Atmosphere: Dry+water-lubricated (60 cc/min)

Speed of rotation: Dry=100 rpm, water-lubricated=300 rpm

Frequency of loading: 0 to 5000 revolutions under dry conditions, and therebeyond under water-lubricated conditions until damage occurred Table 2 shows the hardness of the rails according to this invention and tested for comparison, amounts of wear determined after applying loads 500,000 revolutions under dry conditions using Nishihara's wear tester, and the number of loadings applied before surface defects appeared in the water-lubricated rolling-contact fatigue test on rails and disk-shaped specimens prepared by reducing the configuration of wheels to a scale of $\frac{1}{4}$.

As is evident from Table 2, rails of this invention A to J wore away more than conventional rail M with a pearlitic structure, exhibiting a markedly improved resistance to rolling-contact fatigue. The rolling-contact fatigue resistance of the rails according to this invention was much greater than that of as-rolled rail L with a bainitic structure and rail K with a bainitic structure prepared by naturally cooling the rail head after accelerated cooling.

TABLE 2

| Rail | Simbol | Hardness (Hv) | Amount of Wear (g/500,000 revolutions) | Loading to Surface Defects (revolutions) |
|---|---|---|---|---|
| This Invention | A | 422 | 2.05 | $215 \times 10^4$ |
| | B | 374 | 2.54 | $190 \times 10^4$ |
| | C | 396 | 2.40 | $201 \times 10^4$ |
| | D | 410 | 2.11 | $209 \times 10^4$ |
| | E | 417 | 2.03 | $211 \times 10^4$ |
| | F | 371 | 3.04 | $184 \times 10^4$ |
| | G | 411 | 1.84 | $210 \times 10^4$ |
| | H | 432 | 1.82 | $220 \times 10^4$ |
| | I | 405 | 1.96 | $206 \times 10^4$ |
| | J | 381 | 3.01 | $194 \times 10^4$ |
| For Comparison | K | 328 | 3.06 | $55 \times 10^4$ |
| | L | 321 | 3.10 | $50 \times 10^4$ |
| | M | 260 | 1.24 | $80 \times 10^4$ |

EXAMPLE 2

Table 3 shows the chemical compositions and cooling conditions of rails according to this invention and rails tested for comparison. Table 4 shows their hardness, amounts of wear determined after applying loads 500,000 revolutions under dry conditions using Nishihara's wear tester, and the number of loadings applied before surface defects appeared in the water-lubricated rolling-contact fatigue test on rails and disk-shaped specimens prepared by reducing the configuration of wheels to a scale of $\frac{1}{4}$.

The chemical compositions and cooling conditions of rails A to M were the same as those in Example 1.

As is obvious from Table 4, rails of this invention A to J wore away more than conventional rail M with a pearlitic structure, exhibiting a markedly improved resistance to rolling-contact fatigue. The rolling-contact fatigue resistance of the rails according to this invention was much greater than that of as-rolled rail K with a bainitic structure and rail L with a bainitic structure prepared by naturally cooling the rail head after accelerated cooling.

TABLE 3

| Rail | Simbol | Chemical Composition (wt %) C | Si | Mn | P | S | Cr | Other Element Added | Cooling Conditions: Cooling Start Temperature (°C.) | Cooling Accelerating Rate (°C./sec) | Cooling Stop Temperature (°C.) | Cooling Rate after Accelerated Cooling (°C./min) | Structure |
|---|---|---|---|---|---|---|---|---|---|---|---|---|---|
| This Invention | A | 0.29 | 0.31 | 1.21 | 0.013 | 0.009 | 1.45 | V: 0.08 | 700 | 5 | 400 | 20 | Bainite |
| | B | 0.32 | 0.31 | 1.23 | 0.013 | 0.008 | 1.29 | Mo: 0.25 | 750 | 3 | 375 | 10 | Bainite |
| | C | 0.29 | 0.51 | 1.01 | 0.010 | 0.006 | 1.74 | Nb: 0.04 | 700 | 5 | 425 | 30 | Bainite |
| | D | 0.35 | 0.32 | 0.70 | 0.011 | 0.007 | 2.41 | B: 0.0015 | 800 | 8 | 375 | 20 | Bainite |
| | E | 0.32 | 0.29 | 0.50 | 0.012 | 0.007 | 2.85 | Mo: 0.59 | 750 | 1 | 500 | 1 | Bainite |
| | F | 0.16 | 0.15 | 0.31 | 0.011 | 0.009 | 2.99 | Ni: 2.00 | 800 | 10 | 425 | 40 | Bainite |
| | G | 0.45 | 0.31 | 0.60 | 0.011 | 0.007 | 1.82 | — | 850 | 5 | 450 | 20 | Bainite |
| | H | 0.35 | 1.98 | 0.98 | 0.012 | 0.007 | 1.90 | Ti: 0.032 | 750 | 5 | 400 | 10 | Bainite |
| | I | 0.38 | 0.51 | 1.99 | 0.014 | 0.009 | 0.51 | Cu: 0.11 | 800 | 4 | 400 | 5 | Bainite |
| | J | 0.15 | 0.51 | 1.41 | 0.012 | 0.007 | 0.85 | Mo: 0.30, Ni: 3.89 | 800 | 8 | 350 | 10 | Bainite |
| For Comparison | K | 0.31 | 0.29 | 1.21 | 0.016 | 0.008 | 1.19 | — | Natural cooling after rolling | | | | Bainite |
| | L | 0.79 | 0.51 | 0.91 | 0.020 | 0.009 | 0.21 | — | Heat treatment applied to only rail head | | | | Pearlite |
| | M | 0.69 | 0.25 | 0.89 | 0.013 | 0.007 | — | — | Natural cooling after rolling | | | | Pearlite |

Note: The remainder of both surface-damage- and wear-resistant steels is iron.

TABLE 4

| Rail | Simbol | Hardness (Hv) | Amount of Wear (g/500,000 revolutions) | Loading to Surface Defects (revolutions) |
|---|---|---|---|---|
| This Invention | A | 401 | 2.45 | $201 \times 10^4$ |
| | B | 421 | 2.21 | $205 \times 10^4$ |
| | C | 381 | 2.63 | $183 \times 10^4$ |
| | D | 390 | 2.54 | $194 \times 10^4$ |
| | E | 430 | 2.11 | $210 \times 10^4$ |
| | F | 378 | 2.75 | $184 \times 10^4$ |
| | G | 390 | 2.52 | $192 \times 10^4$ |
| | H | 381 | 2.62 | $185 \times 10^4$ |
| | I | 385 | 2.57 | $190 \times 10^4$ |
| | J | 381 | 2.62 | $186 \times 10^4$ |
| For Comparison | K | 321 | 3.34 | $40 \times 10^4$ |
| | L | 378 | 0.19 | $50 \times 10^4$ |
| | M | 260 | 1.24 | $80 \times 10^4$ |

EXAMPLE 3

Figure 4:
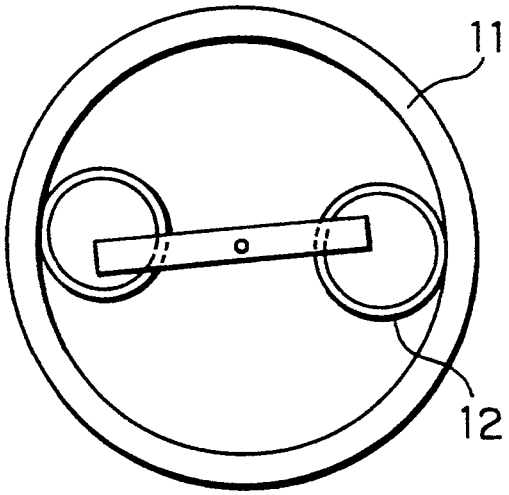
FIG. 4 is a schematic diagram of a tester to determine the surface damage in the head of curved rails.

Table 5 shows the chemical compositions and cooling conditions of rails according to this invention and rails tested for comparison. FIG. 4 is a schematic diagram of a tester to determine the surface defects in rail heads (Japanese Patent No. 1183162). While the rails of this invention and those tested for comparison shown in Table 5 were all made of steels with bainitic structures, with the exception of Nos. 1 and 6. The test was conducted by running wheels 12 over the head of a curved rail 11. Table 6 shows the number of loadings applied before surface damages appeared in the above simulated test. The test was performed under two conditions; one simulating the contact between the wheels and rails in the curved track of railroads and the other simulating the contact in the tangent track. In FIG. 4, reference numerals 11 and 12 designate a curved rail and wheels running thereover.

The test was performed by using a rail heat-treated to a given specification that was curved with a diameter of curvature of 6 m, with the head disposed on the inner side of the formed circle and wheels of the train used on the Shinkansen line. In the test to simulate the condition in the curved track, lateral pressure was applied to the wheel to press the wheel flange against the corner of the rail head, and the resulting damage in the surface of the corner was determined. In the test to simulate the condition in the tangent track, the top end surface of the rail was brought into contact with the center of the wheel, and the resulting damage in the top end surface of the rail head was determined. The rail life up to the appearance of surface defect is expressed in terms of cumulative tonnage of loads as employed with actual railroads.

TABLE 5

| | | C | Si | Mn | Cr | Mo | Ni | Cu | Nb | V | Ti | B | Accelerated Cooling Rate for Corner (°C./sec) | Accelerated Cooling Stop Temperature (°C.) | Cooling Rate after Stopping Accelerated Cooling (°C./min) |
|---|---|---|---|---|---|---|---|---|---|---|---|---|---|---|---|
| This Invention | (1) | 0.15 | 0.80 | 2.00 | 2.00 | | | | | | | | 2 | 450 | 30 |
| | (2) | 0.15 | 0.80 | 2.00 | 0.50 | 0.30 | 2.00 | | | | | | 3 | 435 | 20 |
| | (3) | 0.25 | 1.20 | 1.50 | 2.50 | | | | | | | | 1 | 500 | 40 |
| | (4) | 0.25 | 1.20 | 1.00 | 0.50 | 0.10 | 1.00 | 0.50 | | | | 0.0030 | 8 | 350 | 3 |
| | (5) | 0.35 | 0.80 | 1.00 | 2.00 | | | | | | | | 6 | 400 | 4 |
| | (6) | 0.35 | 0.80 | 1.00 | 2.00 | 0.60 | | | | | 0.015 | | 5 | 380 | 5 |
| | (7) | 0.45 | 0.15 | 0.30 | 3.00 | | | | | | | | 4 | 450 | 10 |
| | (8) | 0.45 | 0.15 | 0.30 | 0.50 | | 4.00 | | 0.20 | 0.150 | | | 10 | 500 | 1 |
| For Comparison | (1) | 0.75 | 0.23 | 0.85 | | | | | | | | | 6 | 400 | 4 |
| | (2) | 0.10 | 0.23 | 2.00 | | | | | | | | | 10 | 500 | 1 |
| | (3) | 0.15 | 1.35 | 2.00 | | | | | | | | | 8 | 350 | 3 |
| | (4) | 0.25 | 0.80 | 0.80 | 3.50 | | | | | | | | 1 | 500 | 40 |
| | (5) | 0.35 | 0.65 | 1.00 | 0.40 | | | | | | | | 3 | 400 | 20 |
| | (6) | 0.55 | 0.23 | 1.00 | 1,25 | | | | | | | | 2 | 450 | 30 |
| | (7) | 0.15 | 0.80 | 2.00 | 2.00 | | | | | | | | 0.5 | 550 | 40 |
| | (8) | 0.45 | 0.15 | 0.30 | 0.50 | | 4.00 | | 0.02 | 0.150 | | | 11 | 350 | 0.5 |

TABLE 6

| Steel | | Rail Head Surface Hardness | Loading to Surface Defect in Tangent Track | Rail Corner Hardness | Loading to Surface Defect in Curved Track |
|---|---|---|---|---|---|
| This Invention | (1) | Hv 350 | $35700 \times 10^4$ | Hv 420 | $8300 \times 10^4$ |
| | (2) | Hv 365 | $33000 \times 10^4$ | Hv 410 | $8250 \times 10^4$ |
| | (3) | Hv 365 | $36700 \times 10^4$ | Hv 425 | $8700 \times 10^4$ |
| | (4) | Hv 390 | $32150 \times 10^4$ | Hv 400 | $8100 \times 10^4$ |
| | (5) | Hv 335 | $41500 \times 10^4$ | Hv 425 | $8300 \times 10^4$ |
| | (6) | Hv 310 | $43600 \times 10^4$ | Hv 410 | $8400 \times 10^4$ |
| | (7) | Hv 340 | $38500 \times 10^4$ | Hv 430 | $8900 \times 10^4$ |
| | (8) | Hv 355 | $34500 \times 10^4$ | Hv 415 | $8500 \times 10^4$ |
| For Comparison | (1) | Hv 285 | $11000 \times 10^4$ | Hv 380 | $3150 \times 10^4$ |
| | (2) | Hv 265 | $19800 \times 10^4$ | Hv 370 | $3850 \times 10^4$ |
| | (3) | Hv 280 | $18500 \times 10^4$ | Hv 365 | $4200 \times 10^4$ |
| | (4) | Hv 395 | $16800 \times 10^4$ | Hv 390 | $4750 \times 10^4$ |
| | (5) | Hv 340 | $27500 \times 10^4$ | Hv 375 | $3900 \times 10^4$ |
| | (6) | Hv 325 | $30500 \times 10^4$ | Hv 325 | $4550 \times 10^4$ |
| | (7) | Hv 275 | $32850 \times 10^4$ | Hv 290 | $3100 \times 10^4$ |
| | (8) | Hv 405 | $11200 \times 10^4$ | Hv 390 | $2000 \times 10^4$ |

Obviously, keeping the hardness of the rail head corner above Hv 400 provides a markedly higher resistance to surface defects than that of the rails tested for comparison, whereas controlling the hardness of the center of the rail head surface of the rail head between Hv 300 and 400 prevents the occurrence of surface defect therein.

EXAMPLE 4

Table 7 shows the chemical compositions and cooling conditions of rails according to this invention and rails tested for comparison. Table 8 shows their hardness, amounts of wear determined after applying loads 500,000 revolutions under dry conditions using Nishihara's wear tester, and the number of loadings applied before surface defects appeared in the water-lubricated rolling-contact fatigue test on rails and disk-shaped specimens prepared by reducing the configuration of wheels to a scale of $\frac{1}{4}$. Table 9 shows the results of a drop weight test on the rails of this invention and those tested for comparison. Table 8 also shows the results of an impact test (the energy absorbed) conducted on the specimens taken from the rail heads.

The chemical compositions and cooling conditions of rails A to J according to this invention and rails K to M tested for comparison were the same as those in Example 1.

TABLE 7

| Rail | Simbol | Chemical Composition (wt %) C | Si | Mn | P | S | Cr | Other Element Added | Cooling Conditions: Cooling Start Temperature (°C.) | Cooling Accelerating Rate (°C./sec) | Cooling Stop Temperature (°C.) | Temperature Increase by Heat Recuperation (°C.) | Structure |
|---|---|---|---|---|---|---|---|---|---|---|---|---|---|
| This Invention | A | 0.31 | 0.30 | 1.21 | 0.013 | 0.009 | 1.71 | V: 0.09 | 900 | 3 | 300 | 49 | Bainite |
| | B | 0.28 | 0.31 | 1.20 | 0.013 | 0.008 | 1.41 | Mo: 0.26 | 800 | 4 | 370 | 1 | Bainite |
| | C | 0.29 | 0.55 | 1.10 | 0.010 | 0.006 | 2.32 | Nb: 0.05 | 700 | 5 | 360 | 8 | Bainite |
| | D | 0.41 | 0.31 | 0.76 | 0.011 | 0.007 | 2.51 | B: 0.0020 | 800 | 8 | 340 | 26 | Bainite |
| | E | 0.31 | 0.32 | 0.40 | 0.012 | 0.007 | 2.91 | Mo: 0.59 | 850 | 1 | 400 | 34 | Bainite |
| | F | 0.35 | 0.15 | 0.31 | 0.011 | 0.009 | 2.98 | Ni: 2.22 | 850 | 10 | 400 | 14 | Bainite |
| | G | 0.45 | 0.31 | 0.61 | 0.011 | 0.007 | 2.26 | — | 800 | 5 | 320 | 48 | Bainite |
| | H | 0.35 | 1.98 | 0.54 | 0.012 | 0.007 | 2.62 | Ti: 0.041 | 850 | 5 | 360 | 16 | Bainite |
| | I | 0.31 | 0.54 | 1.99 | 0.014 | 0.009 | 0.51 | Cu: 0.21 | 800 | 4 | 330 | 35 | Bainite |
| | J | 0.15 | 0.51 | 1.32 | 0.012 | 0.007 | 1.54 | Mo: 0.41, Ni: 3.89 | 750 | 8 | 380 | 42 | Bainite |
| For Comparison | K | 0.31 | 0.29 | 1.40 | 0.015 | 0.008 | 1.41 | — | | Natural cooling after rolling | | | Bainite |
| | L | 0.33 | 0.30 | 1.21 | 0.016 | 0.008 | 1.64 | — | 800 | 12 | 450 | 89 | Bainite |
| | M | 0.69 | 0.25 | 0.89 | 0.013 | 0.007 | — | — | | Natural cooling after rolling | | | Pearlite |

Note: The remainder of both surface-damage- and wear-resistant steels is iron.

TABLE 8

| Rail | Simbol | Hardness (HV) | Absorbed Energy (J/cm²) | Amount of Wear (g/500,000 revolutions) | Loading to Surface Defects (revolutions) |
|---|---|---|---|---|---|
| This Invention | A | 409 | 72 | 2.13 | $215 \times 10^4$ |
| | B | 421 | 96 | 2.02 | $224 \times 10^4$ |
| | C | 402 | 84 | 2.22 | $210 \times 10^4$ |
| | D | 413 | 64 | 2.10 | $205 \times 10^4$ |
| | E | 425 | 61 | 1.98 | $230 \times 10^4$ |
| | F | 384 | 86 | 2.31 | $188 \times 10^4$ |
| | G | 414 | 61 | 1.61 | $194 \times 10^4$ |
| | H | 430 | 69 | 1.81 | $228 \times 10^4$ |
| | I | 376 | 84 | 2.54 | $184 \times 10^4$ |
| | J | 388 | 98 | 2.85 | $178 \times 10^4$ |
| For Comparison | K | 321 | 18 | 3.21 | $45 \times 10^4$ |
| | L | 346 | 36 | 3.05 | $60 \times 10^4$ |
| | M | 260 | 15 | 1.24 | $80 \times 10^4$ |

Impact Test Conditions (Common to All Specimens)
Specimen Cutting Position: Rail head
Type of Specimen: JIS No. 3, 2 mm deep U notch Charpy specimen
Test Temperature: Room temperature (approximately 20° C.)

TABLE 9

| Rail | Simbol | Results of Drop Weight Test (Figures in Parentheses Indicating the Number of Specimens Fractured Out of Four) Drop Weight Test Temperature (°C.) 0 | −10 | −20 | −30 | −40 | −50 | −60 | −70 | −80 | −90 | −100 | −110 |
|---|---|---|---|---|---|---|---|---|---|---|---|---|---|
| This Invention | A | — | — | — | — | — | — | 0 | 0 | 0 | 2 | 4 | — |
| | B | — | — | — | — | — | — | 0 | 0 | 0 | 0 | 2 | 4 |
| | C | — | — | — | — | — | — | 0 | 0 | 0 | 2 | 4 | — |
| | D | — | — | — | — | — | — | 0 | 0 | 2 | 4 | — | — |
| | E | — | — | — | — | — | — | 0 | 0 | 2 | 4 | — | — |
| | F | — | — | — | — | — | — | 0 | 0 | 0 | 2 | 4 | |
| | G | — | — | — | — | — | — | 0 | 0 | 2 | 4 | — | — |
| | H | — | — | — | — | — | — | 0 | 0 | 2 | 4 | — | — |
| | I | — | — | — | — | — | — | 0 | 0 | 0 | 2 | 4 | — |
| | J | — | — | — | — | — | — | 0 | 0 | 0 | 0 | 2 | 4 |

TABLE 9-continued

| Rail | Simbol | Results of Drop Weight Test (Figures in Parentheses Indicating the Number of Specimens Fractured Out of Four) Drop Weight Test Temperature (°C.) | | | | | | | | | | | |
|---|---|---|---|---|---|---|---|---|---|---|---|---|---|
| | | 0 | −10 | −20 | −30 | −40 | −50 | −60 | −70 | −80 | −90 | −100 | −110 |
| For | K | 0 | 0 | 2 | 3 | 4 | — | — | — | — | — | — | — |
| Com- | L | — | — | 0 | 0 | 2 | 4 | — | — | — | — | — | — |
| parison | M | 0 | 0 | 2 | 4 | — | — | — | — | — | — | — | — |

As is obvious from Table 8, rails of this invention A to J wore away more than conventional rail M with a pearlitic structure, exhibiting a markedly improved resistance to rolling-contact fatigue. The rolling-contact fatigue resistance of the rails according to this invention was much greater than that of as-rolled rail K with a bainitic structure and rail L with a bainitic structure prepared by naturally cooling the rail head after accelerated cooling under conditions outside the scope of this invention.

Table 9 shows the results of a drop weight test on the rails of this invention and those tested for comparison, together with the testing conditions employed, in terms of the number of specimens fractured out of four pieces of each steel type. While all of the four specimens of the rails tested for comparison fractured at temperatures between −30° to −50° C., none of the rails according to this invention proved to remain unfractured until the temperature falls to −90° C.

What we claim is:

1. A process for manufacturing high-strength bainitic steel rails with an excellent rolling-contact fatigue resistance comprising the steps of hot-rolling steels consisting of 0.15% to 0.45% carbon, 0.15% to 2.00% silicon, 0.30% to 2.00% manganese, and 0.50% and 3.00% chromium, with the remainder consisting of iron and unavoidable impurities, subjecting the head of an as-rolled rail still hot or of a rail heated to a high temperature to an accelerated cooling from the austenite region to a cooling stop temperature of 500° to 300° C. at a rate of 1° to 10° C. per second, and then cooling the rail head further to a still lower temperature zone.

2. A process for manufacturing high-strength bainitic steel rails with an excellent rolling-contact fatigue resistance according to claim 1, in which the center of the rail head surface of the rail head is heated, following the application of the accelerated cooling, to a temperature not more than 150° C. above the temperature reached on completion of the accelerated cooling, by means of heat recuperation from the interior of the rail, and then naturally cooled to a lower temperature zone.

3. A process for manufacturing high-strength bainitic steel rails with an excellent rolling-contact fatigue resistance according to claim 2, in which the heating by heat recuperation from the interior of the rail is limited to a temperature not more than 50° C. above the temperature reached on completion of the accelerated cooling.

4. A process for manufacturing high-strength bainitic steel rails with an excellent rolling-contact fatigue resistance according to claim 1, in which the rail head subjected to the accelerated cooling is then cooled to the vicinity of room temperatures at a rate of 1° to 40° C. per minute.

5. A process for manufacturing high-strength bainitic steel rails with an excellent rolling-contact fatigue resistance comprising the steps of hot-rolling steels consisting of 0.15% to 0.45% carbon, 0.15% to 2.00% silicon, 0.30% to 2.00% manganese, 0.50% and 3.00% chromium, and at least one element selected from a first group consisting of 0.10% to 0.60% molybdenum, 0.05% to 0.50% copper and 0.05% to 4.00% nickel, a second group consisting of 0.01% to 0.05% titanium, 0.03% to 0.30% vanadium, and 0.01% to 0.05% niobium, and a third group consisting of 0.0005% to 0.0050% boron, with the remainder consisting of iron and unavoidable impurities, subjecting the head of an as-rolled rail still hot or of a rail heated to a high temperature to an accelerated cooling from the austenite region to a cooling stop temperature of 500° to 300° C. at a rate of 1° to 10° C. per second, and then cooling the rail head further to a still lower temperature zone.

6. A process for manufacturing high-strength bainitic steel rails with an excellent rolling-contact fatigue resistance according to claim 5, in which the center of the rail head surface of the rail head is heated, following the application of the accelerated cooling, to a temperature not more than 150° C. above the temperature reached on completion of the accelerated cooling, by means of heat recuperation from the interior of the rail, and then naturally cooled to a lower temperature zone.

7. A process for manufacturing high-strength bainitic steel rails with an excellent rolling-contact fatigue resistance according to claim 6, in which the heating by heat recuperation from the interior of the rail is limited to a temperature not more than 50° C. above the temperature reached on completion of the accelerated cooling.

8. A process for manufacturing high-strength bainitic steel rails with an excellent rolling-contact fatigue resistance according to claim 6, in which the rail head subjected to the accelerated cooling is then cooled to the vicinity of room temperatures at a rate of 1° to 40° C. per minute.

9. A high-strength bainitic steel rail with an excellent rolling-contact fatigue resistance made of steel consisting of 0.15% to 0.45% carbon, 0.15% to 2.00% silicon, 0.30% to 2.00% manganese, and 0.50% and 3.00% chromium, with the remainder consisting of iron and unavoidable impurities, and having a bainitic structure obtained by subjecting to an accelerated cooling from the austenite region to a cooling stop temperature of 500° to 300° C. at a rate of 1° to 10° C. per second and then cooling the rail head further to a still lower temperature zone, with the center of the rail head surface of the rail head having a hardness of Hv 300 to 400 and the gage corner having a hardness of not lower than Hv 350, the hardness of the gage corner being higher than that of the center of the rail head surface by Hv 30 or more.

10. A high-strength bainitic steel rail with an excellent rolling-contact fatigue resistance made of steel consisting of 0.15% to 0.45% carbon, 0.15% to 2.00% silicon, 0.30% to 2.00% manganese, 0.50% and 3.00% chromium, and at least one element selected from a first group consisting of 0.10% to 0.60% molybdenum, 0.05% to 0.50% copper and 0.05% to 4.00% nickel, a second group consisting of 0.01% to 0.05% titanium, 0.03% to 0.30% vanadium, and 0.01% to 0.05% niobium, and a third group consisting of 0.0005% to 0.0050% boron, with the remainder consisting of iron and unavoidable impurities, and having a bainitic structure obtained by subjecting to an accelerated cooling from the austenite region to a cooling stop temperature of 500° to 300° C. at a rate of 1° to 10° C. per second and then cooling the rail head further to a still lower temperature zone, with the center of the rail head surface of the rail head having a hardness of Hv 300 to 400 and the gage corner having a hardness of not lower than Hv 350, the hardness of the gage corner being higher than that of the center of the rail head surface by Hv 30 or more.

* * * * *

UNITED STATES PATENT AND TRADEMARK OFFICE

CERTIFICATE OF CORRECTION

PATENT No. : 5,382,307

DATED : January 17,1995

INVENTOR(S): H. Kageyama et al.

It is certified that error appears in the above-identified patent and that said Letters Patent is hereby corrected as shown below:

Column 15:

In claim 1, line 34, change "0.50% and 3.00%" to --0.50% to 3.00%--.

In claim 5, line 67, change "0.50% and 3.00%" to --0.50% to 3.00%--.

Column 16:

In claim 9, line 47, change "0.50% and 3.00%" to --0.50% to 3.00%--.

In claim 10, line 63, change "0.50% and 3.00%" to --0.50% to 3.00%--.

Signed and Sealed this

Twenty-second Day of August, 1995

*Attest:*

Bruce Lehman

BRUCE LEHMAN

*Attesting Officer*

*Commissioner of Patents and Trademarks*